US006482105B1

(12) United States Patent
Lin

(10) Patent No.: US 6,482,105 B1
(45) Date of Patent: Nov. 19, 2002

(54) GOLF CLUB GRIP

(75) Inventor: Chien-Sung Lin, Taiwan Hsien (TW)

(73) Assignees: Ping-Chao Lin, Taipei Hsien (TW); Tenron Strings Co., Ltd., Taipei Hsien (TW)

( * ) Notice: Subject to any disclaimer, the term of this patent is extended or adjusted under 35 U.S.C. 154(b) by 0 days.

(21) Appl. No.: 09/865,742

(22) Filed: May 25, 2001

(51) Int. Cl.[7] ..... A63B 53/14
(52) U.S. Cl. ..... 473/302
(58) Field of Search ..... 473/300–303, 473/523, 549, 568; 81/489; 16/DIG. 12

(56) References Cited

U.S. PATENT DOCUMENTS 1,954,275 A * 4/1934 Young ..... 473/302
2,000,295 A * 5/1935 Oldham ..... 126/105 A
3,140,873 A * 7/1964 Goodwin ..... 473/302
5,618,041 A * 4/1997 Huang ..... 473/302
RE35,673 E * 11/1997 Huang

FOREIGN PATENT DOCUMENTS

| | | | |
|---|---|---|---|
| AU | 7651/32 | * | 6/1932 |
| GB | 374201 | * | 6/1932 |
| JP | 2-52678 | * | 2/1990 |
| JP | 10-24132 | * | 1/1998 |

* cited by examiner

*Primary Examiner*—Stephen Blau
(74) *Attorney, Agent, or Firm*—Alan D. Kamrath; Rider, Bennett, Egan & Arundel

(57) ABSTRACT

A golf club grip has a grip tube and a polyurethane band winding the grip tube tightly. The grip tube has a helical groove. The polyurethane band has a large number of vent apertures. An adhesive is applied on the polyurethane band. The golf club grip receives a shaft.

7 Claims, 6 Drawing Sheets

GOLF CLUB GRIP

BACKGROUND OF THE INVENTION

The present invention relates to a golf club grip. More particularly, the present invention relates to a golf club grip which has a shock-absorbing function.

Referring to FIG. 1, a conventional golf club grip 10 has a rubber casing 12, and the rubber casing 12 has a large number of decoration patterns 13. Since the rubber casing 12 is very thin, the rubber casing 12 cannot provide a good shock-absorbing function. Furthermore, the decoration patterns 13 will be worn out after a long period of usage so that a user cannot grip the conventional golf club grip stably.

SUMMARY OF THE INVENTION

An object of the present invention is to provide a golf club grip which has a shock-absorbing result.

Another object of the present invention is to provide a golf club grip which is gripped stably.

Accordingly, a golf club grip comprises a grip tube and a polyurethane band winding the grip tube tightly. The grip tube has a helical groove. The polyurethane band has a large number of vent apertures.

DETAILED DESCRIPTION OF THE INVENTION

Figure 1:
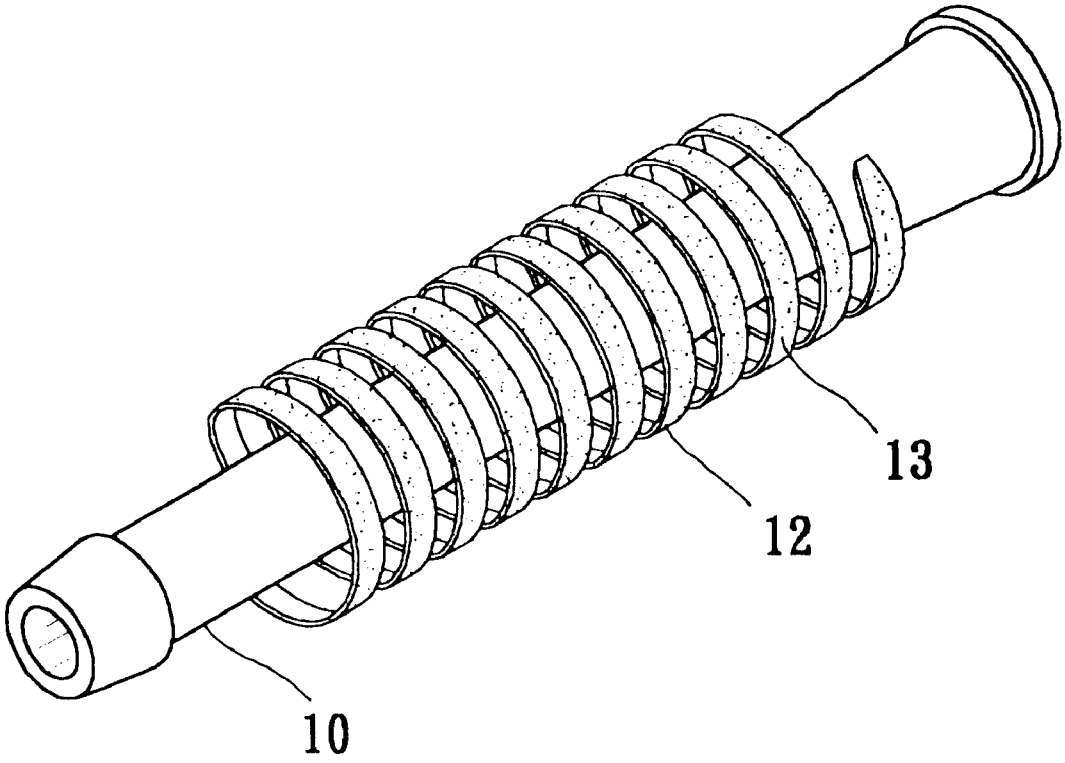
F I G. 1 PRIOR ART
FIG. 1 is a perspective view of a conventional golf club grip of the prior art.
Figure 2:
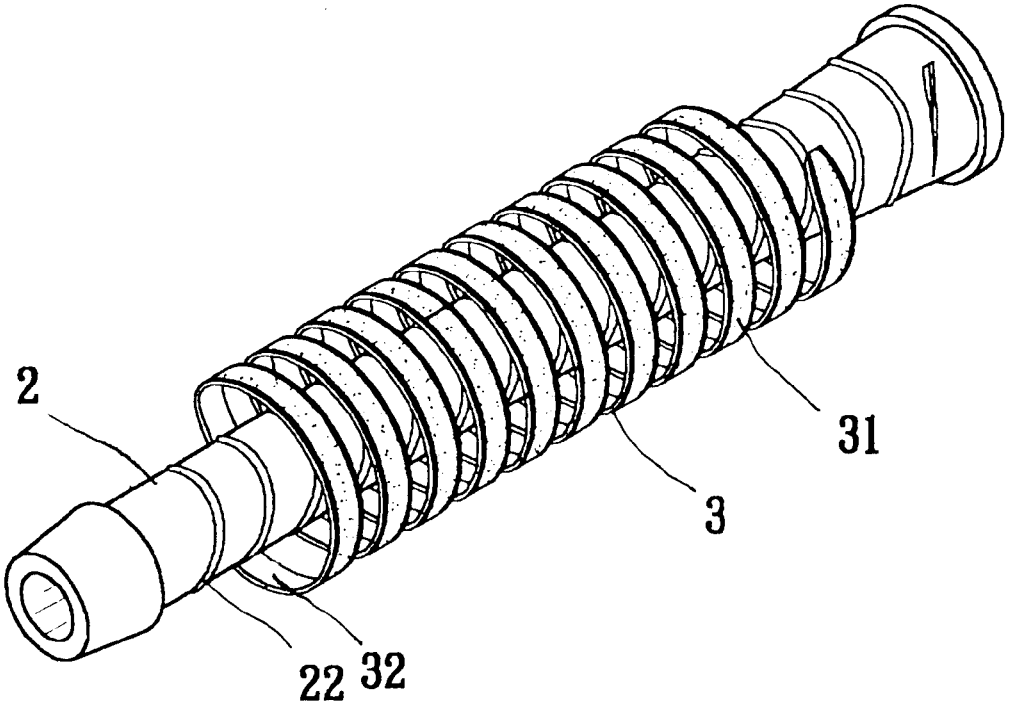
FIG. 2 is a perspective exploded view of a golf club grip of a preferred embodiment in accordance with the present invention.
Figure 3:
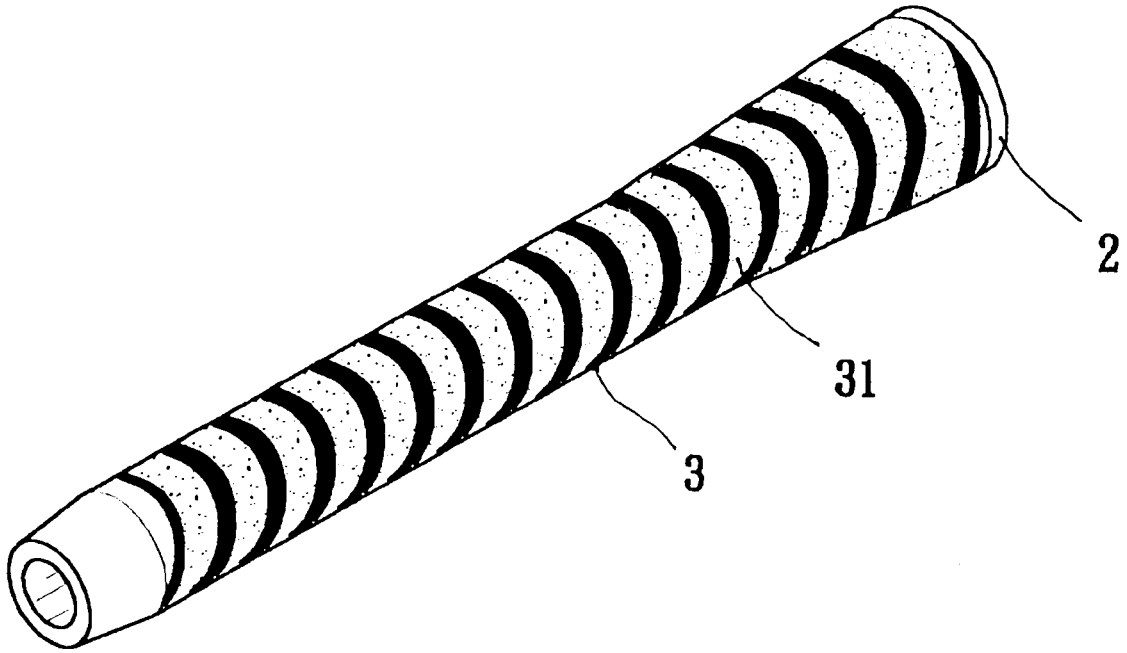
FIG. 3 is a perspective assembly view of a golf club grip of a preferred embodiment in accordance with the present invention.
Figure 4:
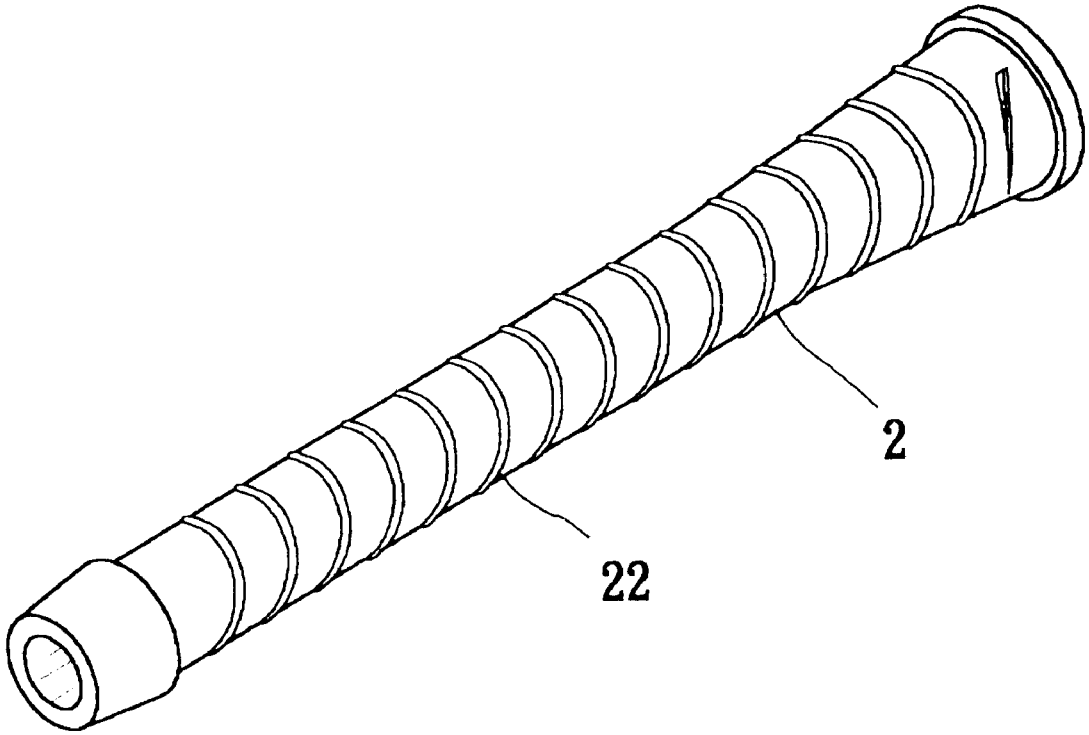
FIG. 4 is a perspective view of a grip tube of a preferred embodiment in accordance with the present invention.
Figure 5:
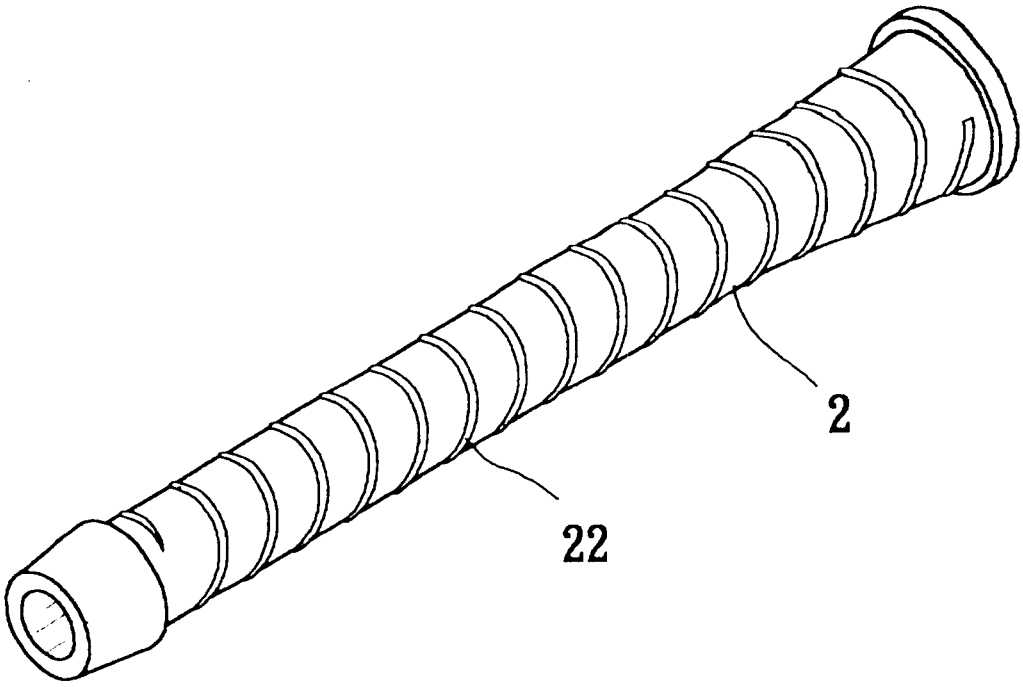
FIG. 5 is another perspective view of a grip tube of a preferred embodiment in accordance with the present invention.
Figure 6:
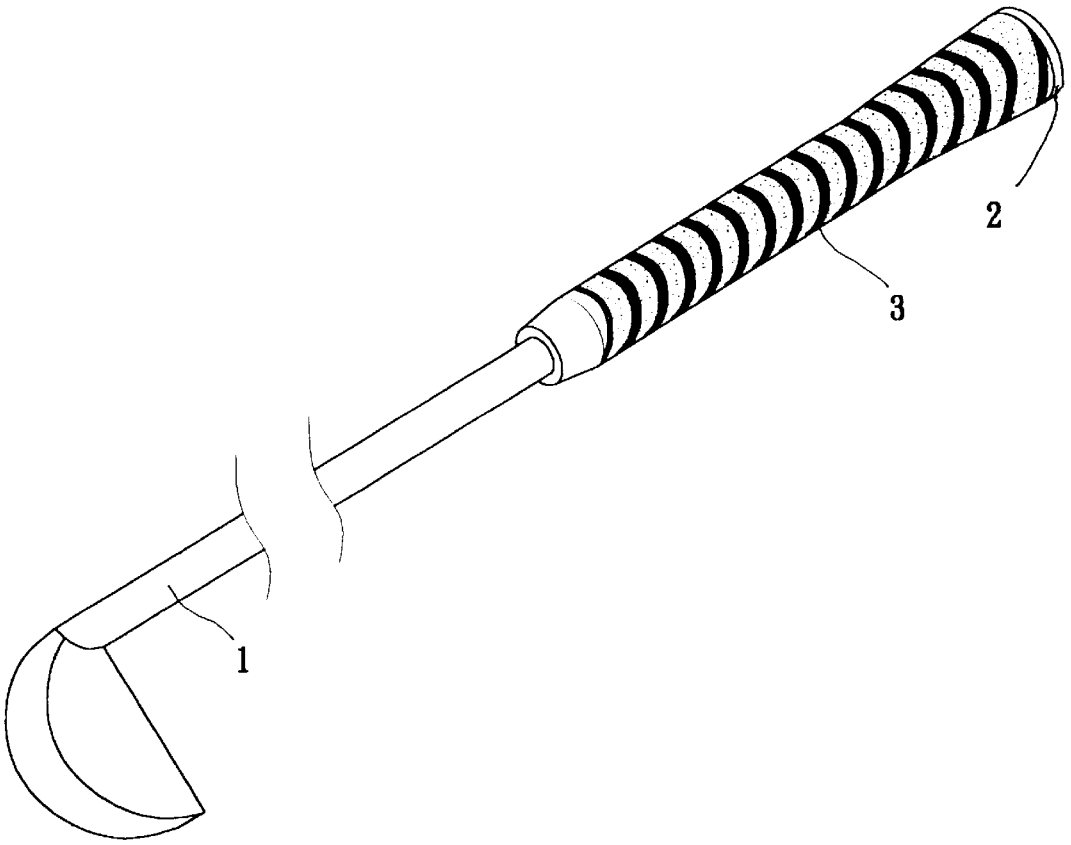
FIG. 6 is a schematic view illustrating a golf club grip of a preferred embodiment disposed on a golf club.

Referring to FIGS. 2 to 7, a golf club grip comprises a grip tube 2 and a polyurethane band 3 winding the grip tube 2 tightly.

The grip tube 2 has a helical groove 22.

The polyurethane band 3 has a large number of vent apertures 31.

The golf club grip receives a shaft 1.

It is an option to apply an adhesive 32 on the polyurethane band 3.

A user will grip the golf club grip stably.

When water enters the grip tube 2 through the vent apertures 31 of the polyurethane band 3, water will flow along the helical groove 22 of the grip tube 2.

The invention is not limited to the above embodiment but various modifications thereof may be made. Further, various changes in form and detail may be made without departing from the scope of the invention.

I claim:

1. A golf club grip comprises:

a grip tube adapted to receive a shaft of a golf club, the grip tube having a helical groove, and a band winding the grip tube tightly and engaging the helical groove of the grip tube, the band having a large number of vent apertures, the bond having a greater width than said groove.

2. The golf club grip as claimed in claim 1, wherein an adhesive is applied on the band.

3. The golf club grip is claimed in claim 2, with the grip tube formed as an integral one piece element and with the helical groove being formed on an outer surface of the integral one piece element.

4. The golf club grip as claimed in claim 3, with the band being formed of polyurethane.

5. The golf club grip is claimed in claim 1, with the grip tube formed as an integral one piece element and with the helical groove being formed on an outer surface of the integral one piece element.

6. The golf club grip as claimed in claim 5, with the band being formed of polyurethane.

7. The golf club grip as claimed in claim 1, with the band being formed of polyurethane.

* * * * *